US009868191B2

(12) United States Patent
He et al.

(10) Patent No.: US 9,868,191 B2
(45) Date of Patent: Jan. 16, 2018

(54) RATCHET WRENCH

(71) Applicants: Ya-Lan He, Taichung (TW); Rong-Suei Chan, Taichung (TW)

(72) Inventors: Ya-Lan He, Taichung (TW); Rong-Suei Chan, Taichung (TW)

( * ) Notice: Subject to any disclaimer, the term of this patent is extended or adjusted under 35 U.S.C. 154(b) by 258 days.

(21) Appl. No.: 14/943,042

(22) Filed: Nov. 17, 2015

(65) Prior Publication Data

US 2017/0136608 A1 May 18, 2017

(51) Int. Cl.
*B25B 13/46* (2006.01)
*B25B 23/00* (2006.01)
*B25B 21/00* (2006.01)

(52) U.S. Cl.
CPC ..... *B25B 13/467* (2013.01); *B25B 13/465* (2013.01); *B25B 13/468* (2013.01); *B25B 21/00* (2013.01); *B25B 23/0007* (2013.01)

(58) Field of Classification Search
CPC ... B25B 13/467; B25B 13/465; B25B 13/468; B25B 21/00; B25B 23/0007
See application file for complete search history.

(56) References Cited

U.S. PATENT DOCUMENTS 6,311,584 B1 * 11/2001 Chu ..... B25B 13/465 81/57.29
6,457,386 B1 * 10/2002 Chiang ..... B25B 13/465 81/57.29
8,230,764 B1 * 7/2012 Lee ..... B25B 13/465 81/177.85
9,751,196 B2 * 9/2017 Hu ..... B25B 13/465

* cited by examiner

*Primary Examiner* — Robert Scruggs

(57) ABSTRACT

A ratchet wrench includes an annular head, a driving unit, a control unit, a rotary member, a second body, a bead and an end piece. The annular head receives the driving unit therein and a shaft extends from the annular head. The driving unit has a top part and a bottom part, between which a first toothed ring, a first pawl, two second pawls, a third pawl and a second toothed ring are pivotably located. The rotary member is rotatably inserted into an axial hole of the shaft and has third teeth, a recess and an engaging groove. The third teeth are engaged with the first and second toothed rings. A bead biased by a spring located in the shaft and is engaged with the engaging groove. The recess of the rotary member is connected with the second body.

9 Claims, 9 Drawing Sheets

RATCHET WRENCH

BACKGROUND OF THE INVENTION

1. Fields of the Invention

The present invention relates to a ratchet wrench, and more particularly, to a ratchet wrench having a driving unit with two adjustable toothed rings so as to be precisely engaged with related components.

2. Descriptions of Related Art

The conventional ratchet wrench known to applicant is disclosed in U.S. Pat. No. 6,457,386 and comprises a main body, a drive shaft, a handle, a first annular gear, a second annular gear, a drive member, a pair of first pawls, a pair of second pawls, a rotating wheel, a control member, a plurality of balls, a plurality of compression springs, and a coiled spring. The main body has a through hole to receive the drive shaft, a pair of pivot holes, a groove to receive the drive member, and a plurality of inner teeth. The through hole communicates with the groove. The drive member has a through aperture and a chamber. The handle has a blind hole to receive the drive shaft. The first annular gear has a plurality of inner periphery serrations and a plurality of one-sided serrations. The second annular gear has a plurality of inner periphery teeth and a plurality of one-sided teeth. Each of the first pawls has a plurality of positioning recesses and a plurality of outer teeth. Each of the second pawls has a plurality of periphery serrations and a plurality of one-sided serrations. The rotating wheel has an oblong center hole. The control member has a pillar and a press disk disposed on the pillar. The pillar has a plurality of circular holes, and each of the circular holes of the pillar receives the corresponding compression spring and the corresponding ball. A pair of studs pass through the pivot holes of the main body and an annular recess of the drive shaft. The chamber of the drive member receives the first pawls and the second pawls. The first annular gear encloses one of the first pawls and one of the second pawls. The second annular gear encloses the other of the first pawls and the other of the second pawls. The pillar is inserted through the coiled spring, the oblong center hole of the rotating wheel, and the through aperture of the drive member. The coiled spring is disposed between the press disk and the rotating wheel, and each of the balls engages with one of the first pawls and the second pawls.

However, the two second annular gears are not adjustable relative to the driving member so that the engagement between the beveled teeth of the drive shaft and the two second annular gears may not be perfect as expected. Each of the driving member, the second annular gears and the drive shaft has its own tolerance, if the tolerance is too big, the engagement between the beveled teeth of the drive shaft and the two second annular gears is affected. The maximum diameter of the driving member has to be matched with the inner teeth of the inner teeth so that the driving member is supported by the inner teeth. The main body and the driving member are pivotably connected to the inner teeth, the pivotable connection between the main body and the driving member will be affected. The driving member is made as a one piece and this requires higher manufacturing cost.

Another ratchet wrench is disclosed in U.S. Pat. No. 9,038,505 has similar shortcomings as those in U.S. Pat. No. 6,457,386.

The present invention intends to provide a ratchet wrench to eliminate the shortcomings mentioned above.

SUMMARY OF THE INVENTION

The present invention relates to a ratchet wrench and comprises an annular head, a driving unit, a control unit, a rotary member, a second body, a bead and an end piece. The annular head receives the driving unit therein and a shaft extends from the annular head. The driving unit has a top part and a bottom part, between which a first toothed ring, a first pawl, two second pawls, a third pawl and a second toothed ring are pivotably located. The rotary member is rotatably inserted into an axial hole of the shaft and has third teeth, a recess and an engaging groove. The third teeth are engaged with the first and second toothed rings. A bead biased by a spring located in the shaft and is engaged with the engaging groove. The recess of the rotary member is connected with the second body.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
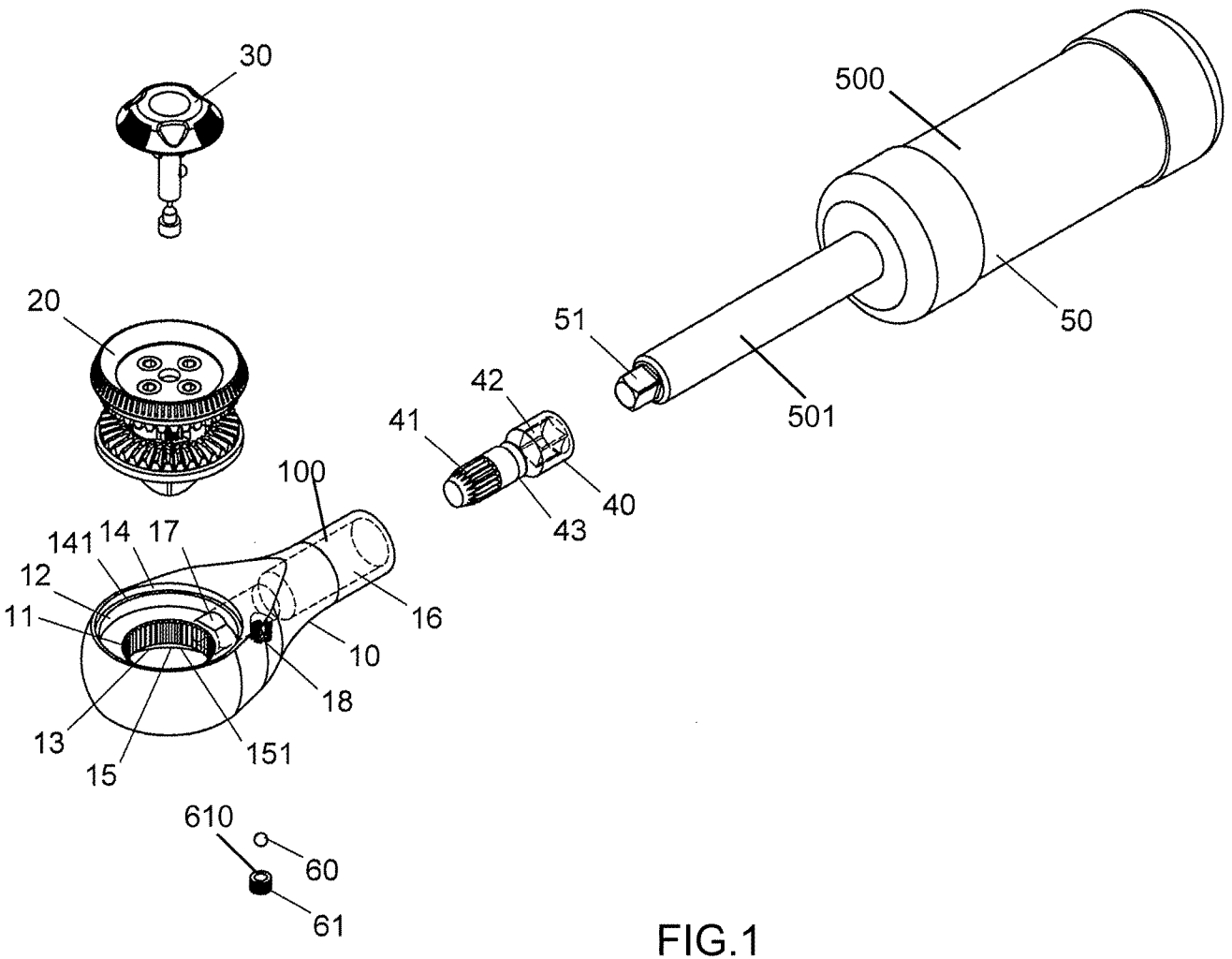
FIG. 1 is an exploded view of the ratchet wrench of the present invention.
Figure 2:
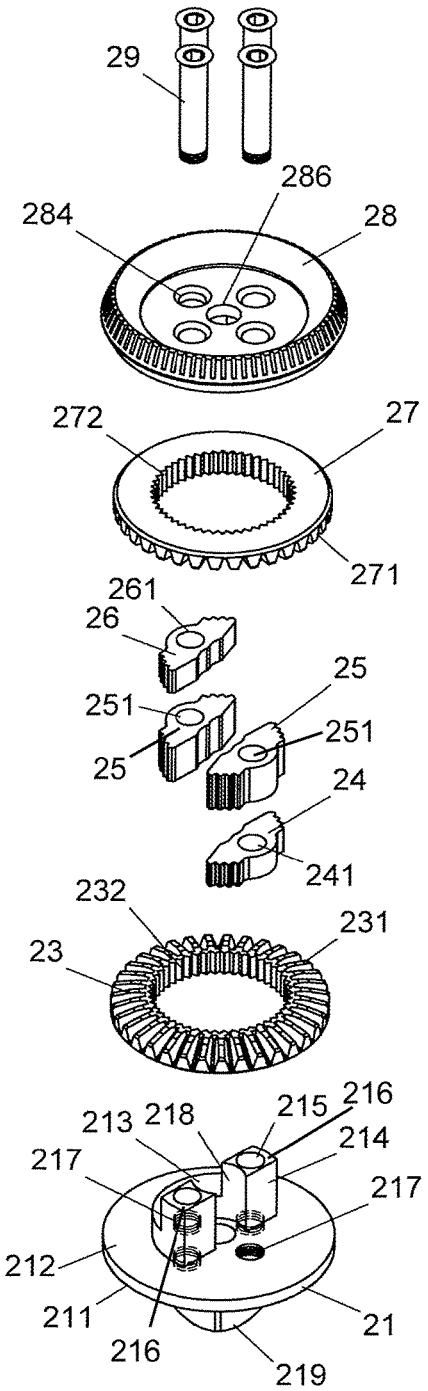
FIG. 2 is an exploded view of the driving unit of the ratchet wrench of the present invention.
Figure 4:
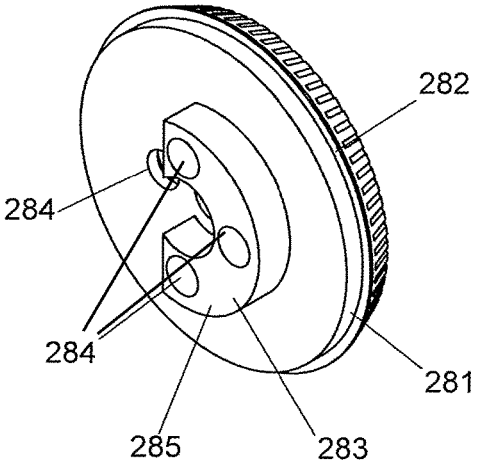
FIG. 4 is a perspective view to show the top part of the driving unit of the present invention.
Figure 3:
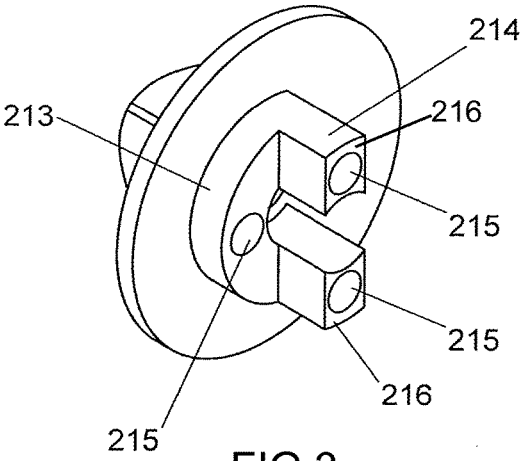
FIG. 3 is a perspective view to show the bottom part of the driving unit of the present invention.
Figure 5:
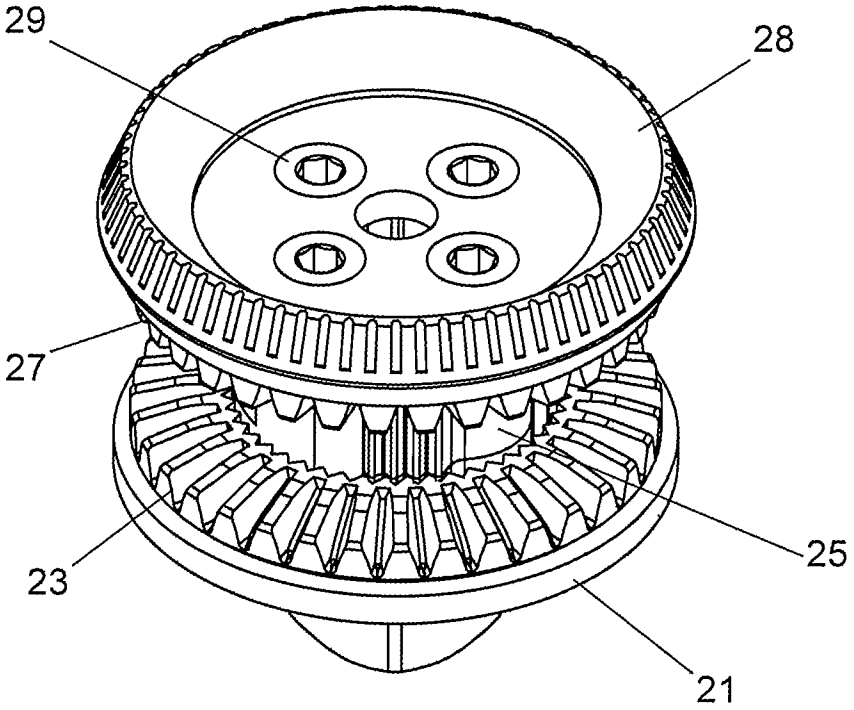
FIG. 5 is a perspective view to show the driving unit of the present invention.
Figure 6:
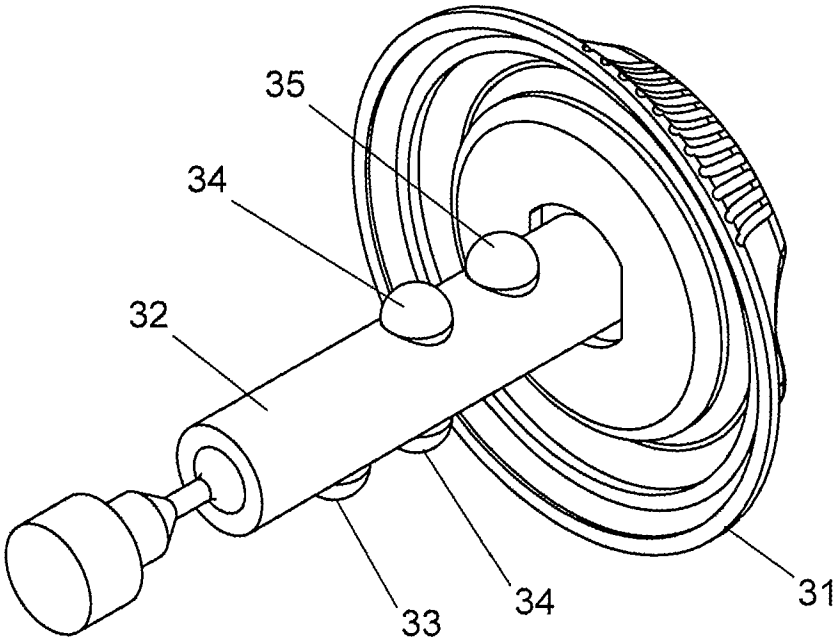
FIG. 6 is a perspective view to show the control unit of the present invention.

Referring to FIGS. 1 to 6, the ratchet wrench of the present invention comprises an annular head 10, a driving unit 20, a control unit 30, a rotary member 40, a bead 60 and an end piece 61.

The annular head 10 has a shaft 100 extending therefrom. Multiple ratchet teeth 11 are defined in the middle portion of the inner periphery of the annular head 10. A first space 12 and a second space 13 are respectively defined in the top and the bottom of the inner periphery of the annular head 10, wherein the first and second spaces 12, 13 have the same diameter which is larger than the diameter enclosed by the ratchet teeth 11. A first groove 14 is defined in the inner periphery of the first space 12, and a second groove 15 is defined in the inner periphery of the second space 13. A first shoulder 141 is formed between the first groove 14 and the first space 12, and a second shoulder 151 is formed between the second groove 15 and the second space 13. An axial hole 16 is defined axially in the shaft 100. A communication hole 17 is defined in the inner end of the axial hole 16 and communicates with the first and second spaces 12, 13. The communication hole 17 does not communicate the ratchet teeth 11. A receiving hole 18 is defined in one side of the shaft 100 and communicates with the axial hole 16.

The driving unit 20 is located in the annular head 10 and has a bottom part 21, a first toothed ring 23, a first pawl 24, two second pawls 25, a third pawl 26, a second toothed ring 27, a top part 28 and four locking members 29. The bottom plate 21 is a round disk and its periphery is engaged with the second groove 15. The bottom part 21 has a first disk 212 which contacts the second shoulder 151. The first disk 212 has four locking holes 217, a base 213 and two columns 214. Each column 214 has a first end face 216. The height of the two columns 214 from the first disk 212 is higher than that of the base 213. The base 213 and the two columns 214 each have a circular hole 215 defined therethrough, and each circular hole 215 communicates with the locking hole 217 corresponding thereto. A receiving room 218 is formed between the base 213 and the columns 214, and each of the columns 214 is a rectangular column. Three of the locking holes 217 respectively extend through the base 213 and the first end faces 216 of the columns 214.

The bottom part 21 has a driving end 219 extending from the first disk 212. The driving end 219 is a rectangular end for being connected to a rectangular recess of a socket, a connection rod, or an adapter. The first toothed ring 23 is located on the first disk 212 and mounted to the base 213 and rotatably received in the second space 13. The first toothed ring 23 having first teeth 231 and first inner teeth 232. The first inner teeth 232 have the same number teeth and inner diameter as the ratchet teeth 11. The first pawl 24 is pivotably connected to the first disk 212 and located on one side of the two columns 214 and located away from the base 213. A first toothed portion is formed on each of two ends of the first pawl 24 and engaged with the first inner teeth 232. The first pawl 24 has a first hole 241 which is located in alignment with one of the locking holes 217. One of the two second pawls 25 is mounted to the base 213, and the other second pawl 25 is located above the first pawl 24. The two second pawls 25 are located symmetrically to each other relative to the columns 214. A second toothed portion is formed on each of two ends of each of the second pawls 25 so as to be engaged with the ratchet teeth 11. Each of the two second pawls 25 has a second hole 251. The second hole 251 of one of the second pawls 25 that is located above the base 213 is located in alignment with the circular hole 215 and the locking hole 217 corresponding thereto. The second hole 251 of the other one of the second pawls 25 that is located above the first pawl 24 is located in alignment with the first hole 241 and the locking hole 217 corresponding thereto. The third pawl 26 is pivotably connected to the top of the second pawl 25 on the base 213. A third toothed portion is formed on each of two ends of the third pawl 26. A third hole 261 is defined through the third pawl 26 and which is located in alignment with the second hole 251, the circular hole 215 and one of the locking holes 217 corresponding thereto. The second toothed ring 27 is rotatably received in the first space 12 and has second teeth 271 which face the first teeth 231 at a distance. The second toothed ring 27 has second inner teeth 272 which are engaged with the third toothed portions of the third pawl 26. The second toothed ring 27 is identical to the first toothed ring 23.

The top part 28 is a round disk and faces the bottom part 21 at a distance. The periphery 281 of the top part 28 is rotatably received in the first groove 14. The top part 28 has a second disk 282 which contacts the first shoulder 141. A block 283 extends from the second disk 282. The second toothed ring 27 is mounted to the block 283. The top part 28 has four connection holes 284 which are located in alignment with the circular holes 215 and the locking holes 217. The block 283 has a second end face 285 which is located close to the first end faces 216 of the columns 214. The second pawl 25 located above the first pawl 24 has a top face which is located close to the second end face 285. There are three connection holes 284 defined in the block 283. The top part 28 has a fourth hole 286 defined centrally therethrough, the fourth hole 286 is located in alignment with the receiving room 218.

The four locking members 29 respectively extend through the connection holes 284, the first hole 241, the second holes 251, the third hole 261 and the circular holes 215, and are locked to the locking holes 217 to pivotably connect the first pawl 24, the second pawls 25 and the third pawl 26 to the locking members 29. The locking members 29 each are a cylindrical member and has threads at one end thereof. Two of the locking members 29 extend through the connection holes 284 of the top part 28 and the circular holes 215 of the bottom part 21 and are locked to the locking holes 217 corresponding thereto. One of the four locking members 29 extends through the connection hole 284 of the top part 28, the second hole 251, the first hole 251 and the first hole 241 and is locked to the locking hole 217 corresponding thereto. Another one of the locking members 29 extends through the connection hole 284 of the top part 28, the third hole 261, the second hole 251 and the circular hole 215 and is locked to the locking hole 217 corresponding thereto.

The control unit 30 is connected to the driving unit 20 and has an operation disk 31, a shaft 32, a first controller 33, two second controllers 34 and a third controller 35. The operation disk 31 is pivotably connected to the top part 28 and protrudes beyond the annular head 10 such that the user can rotates the operation disk 31. The shaft 32 extends from the center of the operation disk 31 and is pivotably extends through the fourth hole 286 and inserted into the receiving room 218 of the bottom part 21. The first controller 33 is a semi-circular member and protrudes radially from the shaft 32 and is located in alignment with the inside of the first pawl 24 so as to control the direction of rotation of the first pawl 24. The two second controllers 34 each are a semi-circular member and symmetrically extend from the outside of the shaft 32 and are located in alignment with two respective insides of the second pawls 25 so as to control the direction of rotation of the two second pawls 25. The third controller 35 protrudes radially from the shaft 32 and is located in alignment with the inside of the third pawl 25 so as to control the direction of rotation of the third pawl 25.

The rotary member 40 is pivotably located in the axial hole 16 and has third teeth 41 at the front end thereof. The third teeth 41 are engaged with the first and second teeth 231, 271 at the communication hole 17. A rectangular recess 42 is defined in the rear end of the rotary member 40. An engaging groove 43 is defined in the outside of the rotary member 40 and located in alignment with the receiving hole 18. A protrusion 51 of a second body 50 is received in the recess 42. The second body 50 is a pneumatic tool, an electric tool, or a hand tool. The second body 50 has a handle 500 and a shank 501, the protrusion 51 protrudes from one end of the shank 501. The protrusion 51 rotates the rotary member 40 in the axial hole 16.

The bead 60 is located in the receiving hole 18 and engaged with the engaging groove 43 so that the rotary member 40 is restricted by the bead 60 and does not drop from the axial hole 16. When the rotary member 40 is rotated by the second body 50, the bead 60 rolls in the engaging groove 43 to reduce wearing. The end piece 61 is securely engaged with the receiving hole 18 and restricts the bead 60 from dropping out from the receiving hole 18. The end piece 61 has outer threads which are threadedly connected to the receiving hole 18. The end piece 61 has a curved recess 610 in the front end thereof. The curved recess 610 receives the bead 60.

Figure 7:
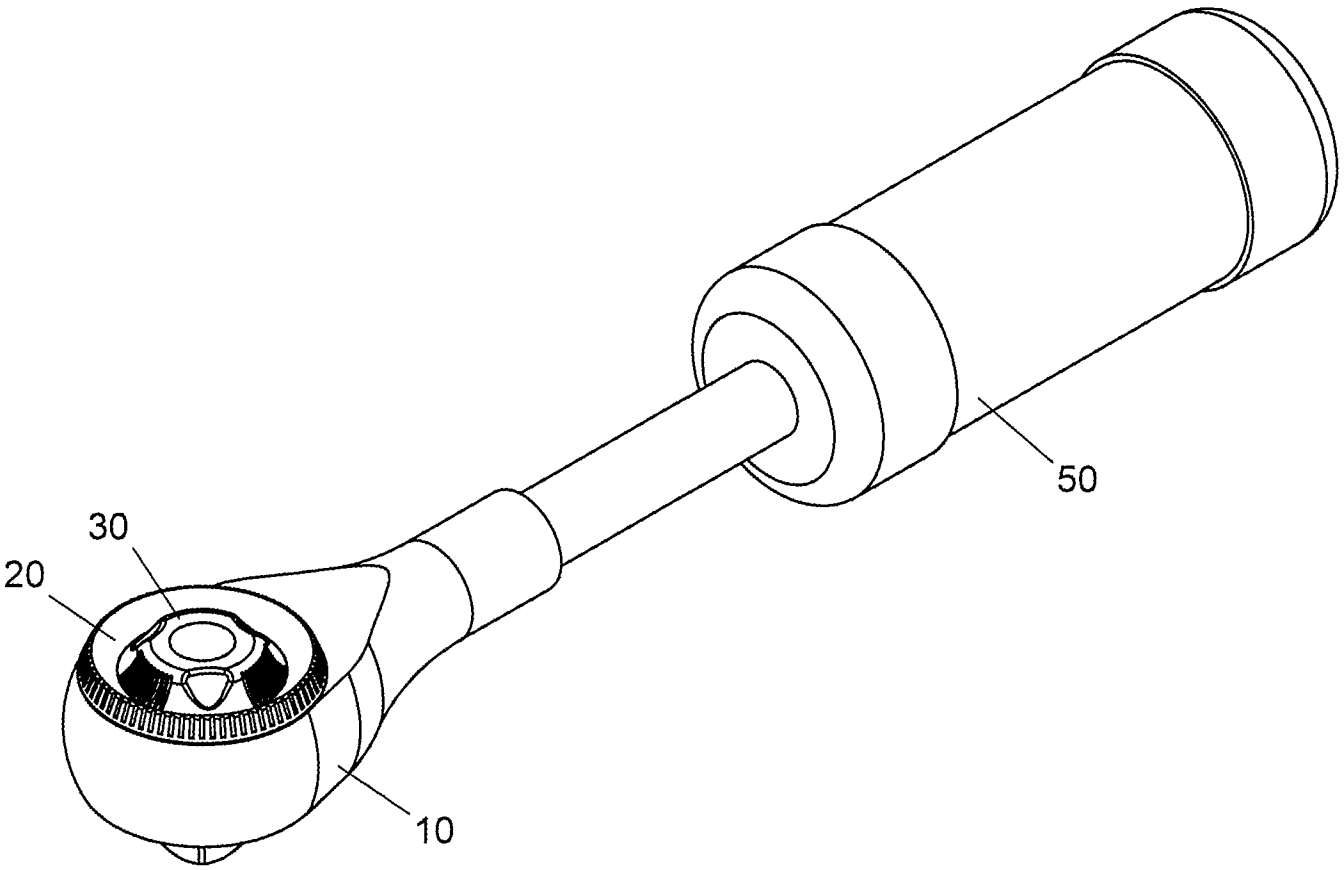
FIG. 7 is a perspective view to show the ratchet wrench of the present invention.

As shown in FIG. 7, the driving unit 20 is connected to the annular head 10. The top part 28 protrudes from the annular head 10. The control unit 30 is located in the driving unit 20. The operation disk 31 is pivotably connected to the top part 28 and protrudes beyond the annular head 10 so that the user may rotate it to change the operation direction of the driving unit 20. The rotary member 40 is rotatably received in the axial hole 16 and the communication hole 17. The second body 50 is connected to the rotary member 40. The bead 60 and the end piece 61 are located in the receiving hole 18. The bead 61 restricts the rotary member 40 from dropping out from the shaft 100.

Figure 8:
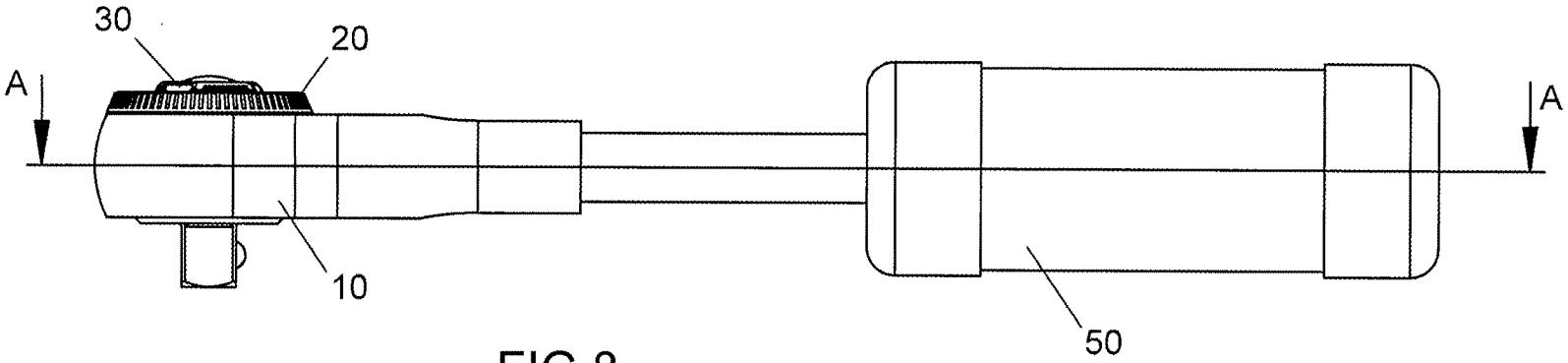
FIG. 8 is a side view of the ratchet wrench of the present invention.
Figure 9:
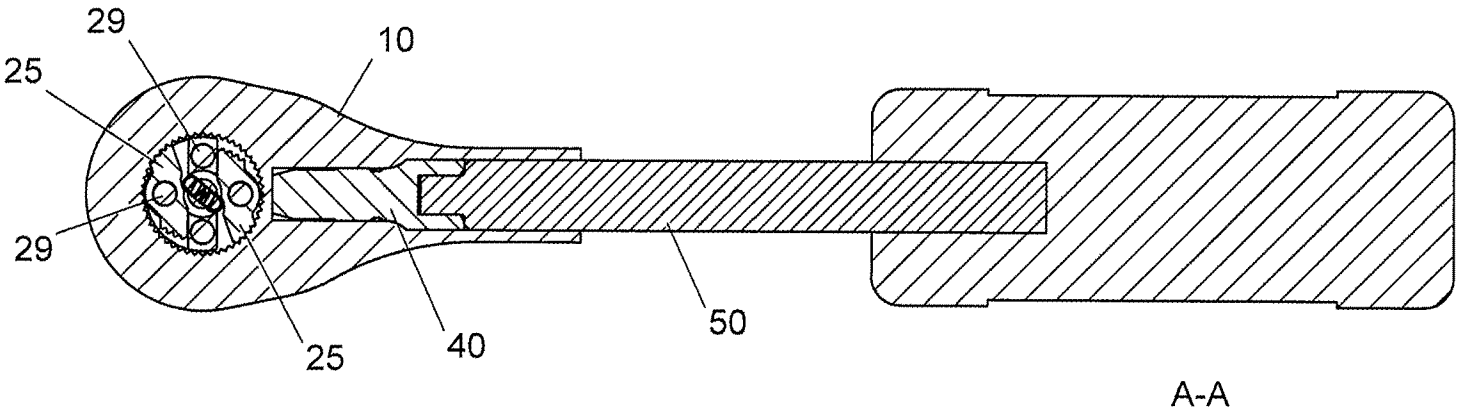
FIG. 9 is a cross sectional view, taken along line A-A in FIG. 8.

As shown in FIGS. 8 and 9, the locking members 29 extend through the connection holes 284, the first hole 241, the second holes 251, the third hole 261, the circular holes 215 and are locked to the locking holes 217 to pivotably connect the first pawl 24, the second pawls 25 and the third pawl 26 to the locking members 29. The second toothed portions of the second pawls 25 are engaged with the ratchet teeth 11. The shaft 32 is inserted into the receiving room 218. The second controllers 34 contact the insides of the second pawls 25 to change the rotational direction of the second pawls 25.

Figure 10:
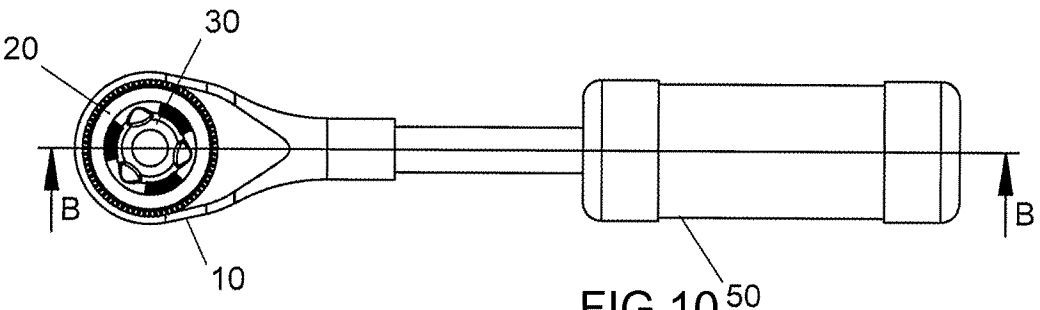
FIG. 10 is a top view to show the ratchet wrench of the present invention.
Figure 11:
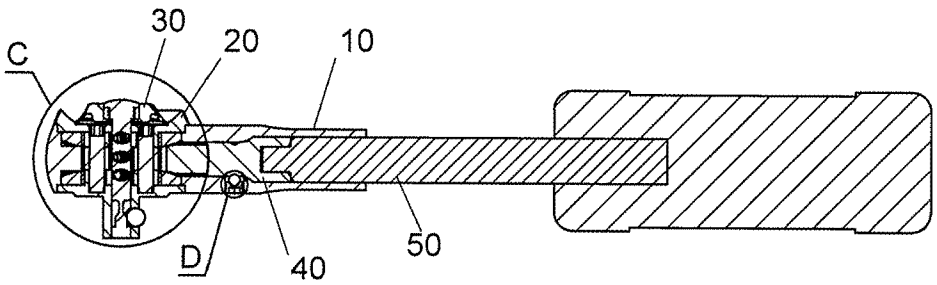
FIG. 11 is a cross sectional view, taken along line B-B in FIG. 10.
Figure 12:
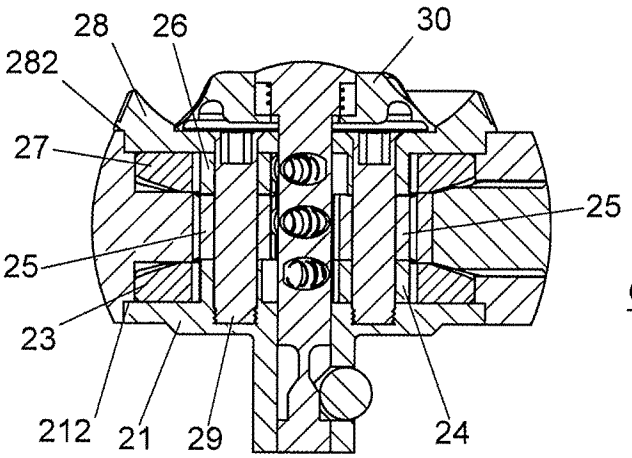
FIG. 12 is an enlarged view of the circled C in FIG. 11.

As shown in FIGS. 10 to 12, the bottom part 21 is engaged with the first groove 15 and protrudes beyond the annular head 10. The first toothed ring 23 is located in the second space 13. The first pawl 24 is located on the first disk 212 and located in the first toothed ring 23. The first toothed portions 24 are engaged with the first inner teeth 232. The two second pawls 25 are located above the first pawl 24 and the base 213. The second toothed portions of the second pawls 25 are engaged with the ratchet teeth 11. The third pawl 26 is located on the second disk 282 and located between the second pawls 25 and the second disk 282. The second toothed ring 27 is located in the first space 12. The third pawl 26 is located in the second toothed ring 27. The third toothed portions of the third pawl 26 are engaged with the second inner teeth 272. The top part 28 is engaged with the first groove 14 and protrudes beyond the annular head 10. The four locking members 29 assemble the parts of the driving unit 20 together. The control unit 30 is pivotably connected to the driving unit 20, and the operation disk 31 is exposed beyond the annular head 10 for being operated by the user. The first, second and third controllers 33, 34, 35 respectively contact the inside of the first pawl 24, the second pawls 25 and the third pawl 26. The operation disk 31 is rotated to change the rotational direction of the first, second and third pawls 24, 25, 26. The rotary member 40 is rotatably received in the axial hole 16 and its third teeth 41 are engaged with the first and second teeth 231, 271 at the communication hole 17. When the rotary member 40 is rotated, the third teeth 41 drives the first and second toothed rings 23, 27 simultaneously. The protrusion 51 is engaged with the recess 42.

Figure 13:
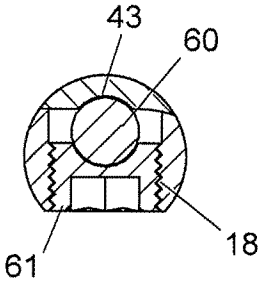
FIG. 13 is an enlarged view of the circled D in FIG. 11.

As shown in FIG. 13, the bead 60 and the end piece 61 are located in the receiving hole 18. The bead 60 is engaged with the engaging groove 43 so that the rotary member 40 is restricted by the bead 60 and does not drop from the axial hole 16. The bead 60 rolls in the engaging groove 43 to reduce wearing.

Figure 14:
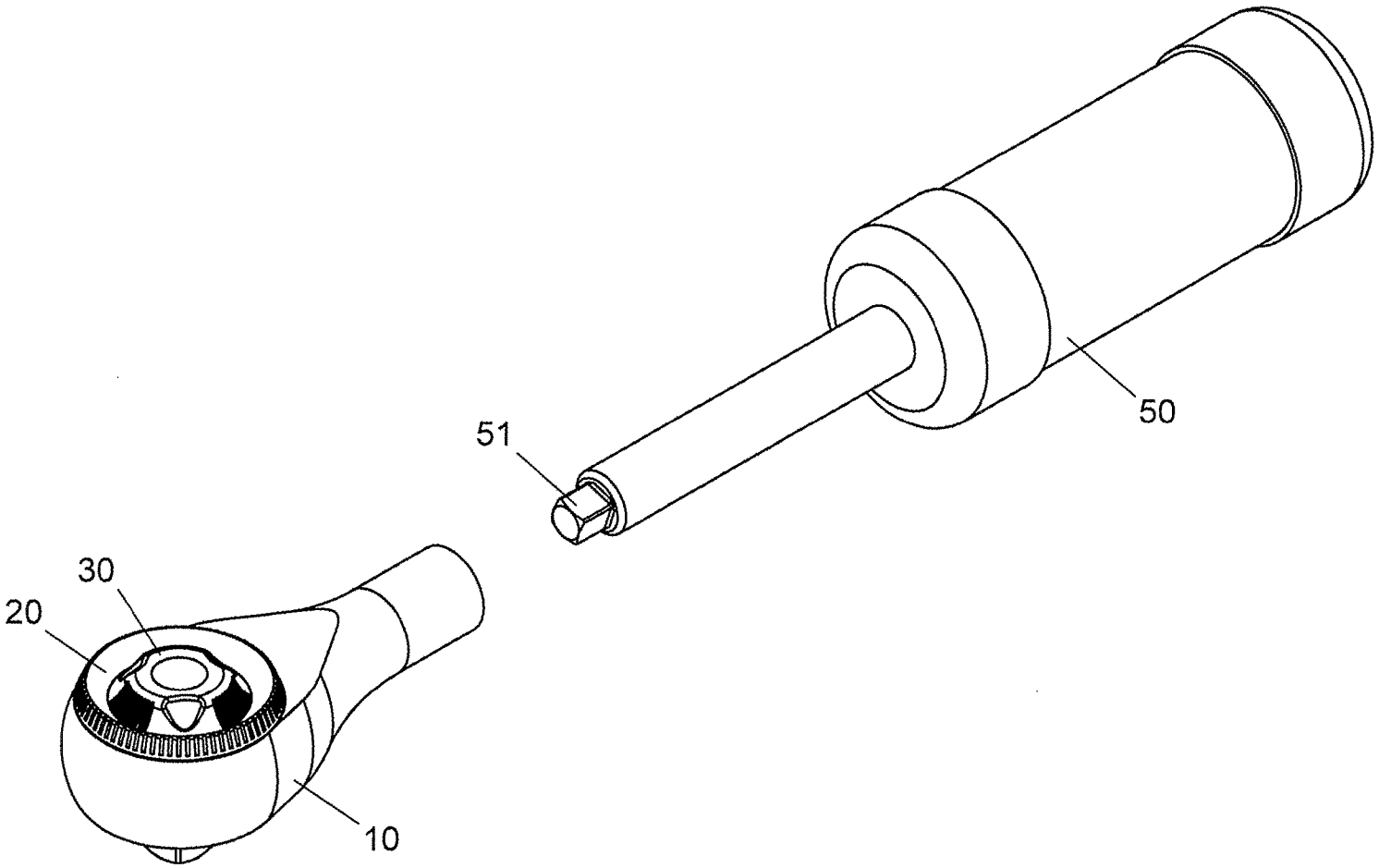
FIG. 14 shows that the rotary member is separated from the second body.

As shown in FIG. 14, the rotary member 40 is located in the axial hole 16. When the rotary member 40 is separated from the second body 50, the protrusion 51 is exposed and able to be connected with other hand tools to use the second body 50 as another hand tool.

Figure 15:
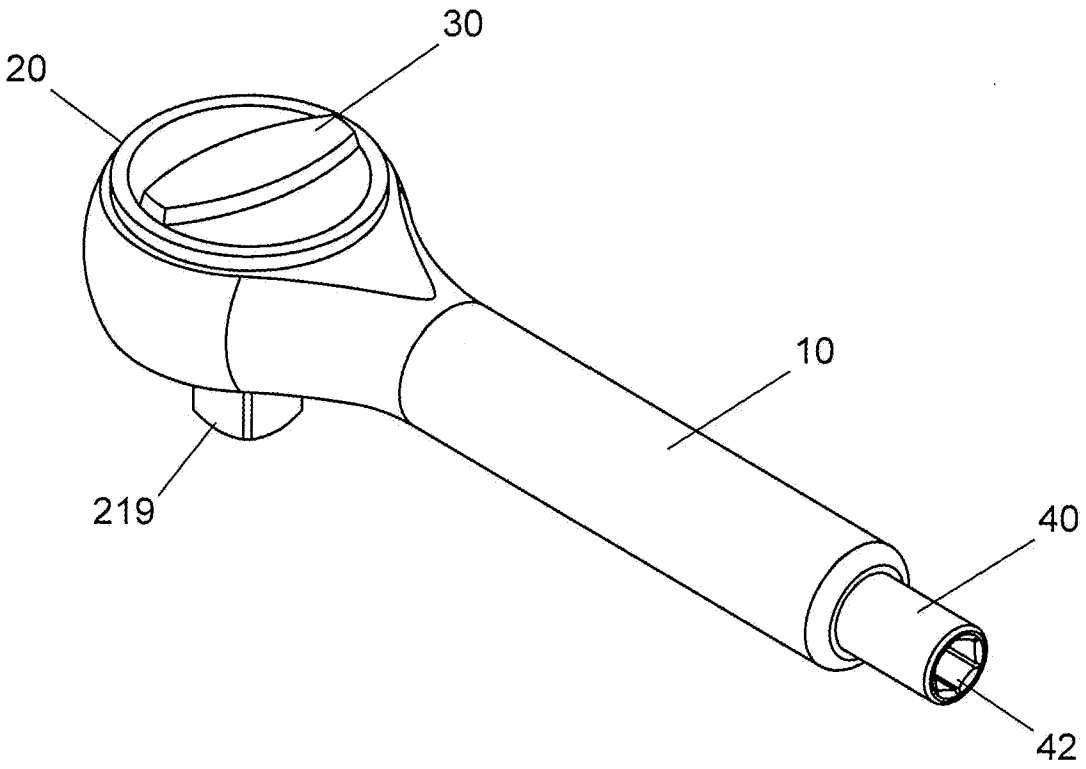
FIG. 15 is a perspective view to show the second embodiment of the ratchet wrench of the present invention.

As shown in FIG. 15, the top part 28 is received in the annular head 10, and the operation disk 31 is exposed from the annular head 10 so as to be operated by the users. The recess 42 of the rotary member 40 is located in the axial hole 16 and is a hexagonal recess.

In another embodiment, a resilient plate is clamped between the first end face 216 of the bottom part 21 and the second end face 285 of the top part 28 so as to adjust the distance between the top part 28 and the bottom part 21.

By the threading connection between the locking members 29 and the locking holes 217, the distance between the top part 28 and the bottom part 21 can be adjusted. The positions of the first and second toothed rings 23, 27 can also be adjusted. The engagement between the third teeth 41 and the first teeth 231 and the second teeth 271 is stable as expected.

The periphery 211 of the bottom part 21 is engaged with the second groove 15, and the periphery 281 of the top part 28 is engaged with the first groove 14 so that the connection between the annular head 10 and the driving unit 20 is stable.

The first disk 212 contacts the second shoulder 151, and the second disk 282 contacts the first shoulder 141, so that the driving unit 20 does not drop from the annular head 10.

The bottom part 21, the first toothed ring 23, the first pawl 24, the second pawls 25, the third pawl 26, the second toothed ring 27 and the top part 28 are stably connected by the locking members 29.

The wearing between the rotary member 40 and the engaging groove 43 is reduced by the bead 60 locate between the engaging groove 43 and the end piece 61.

While we have shown and described the embodiment in accordance with the present invention, it should be clear to those skilled in the art that further embodiments may be made without departing from the scope of the present invention.

What is claimed is:

1. A ratchet wrench comprising:

an annular head having a shaft extending therefrom, multiple ratchet teeth defined in an middle portion of an inner periphery of the annular head, a first space and a second space respectively defined in a top and a bottom of the inner periphery of the annular head, the first and second spaces having the same diameter which is larger than a diameter enclosed by the ratchet teeth, a first groove defined in an inner periphery of the first space, a second groove defined in an inner periphery of the second space, a first shoulder formed between the first groove and the first space, a second shoulder formed between the second groove and the second space, an axial hole defined axially in the shaft, a communication hole defined in an end of the axial hole and communicating with the first and second spaces, a receiving hole defined in one side of the shaft and communicating with the axial hole;

a driving unit located in the annular head and having a bottom part, a first toothed ring, a first pawl, two second pawls, a third pawl, a second toothed ring, a top part and four locking members, a periphery of the bottom part engaged with the second groove, the bottom part having a first disk which contacts the second shoulder, the first disk having four locking holes, a base and two columns, each column having a first end face, a height of the two columns from the first disk being higher than that of the base, the base and the two columns each having a circular hole defined therethrough, each circular hole communicating with the locking hole corresponding thereto, three of the locking holes respectively extending through the base and two respective first end faces of the columns, the bottom part having a second disk, a driving end extending from the second disk, the first toothed ring located on the first disk and mounted to the base and being rotatably received in the second space, the first toothed ring having first teeth and first inner teeth, the first pawl pivotably connected to the first disk and located on one side of the two columns, a first toothed portion formed on each of two ends of the first pawl and engaged with the first inner teeth, the first pawl having a first hole which is located in alignment with one of the locking holes, one of the two second pawls mounted to the base, the other second pawl located above the first pawl, the two second pawls being located symmetrically to each other relative to the columns, a second toothed portion formed on each of two ends of each of the second pawls so as to be engaged with the ratchet teeth, each of the two second pawls having a second hole, the second hole of one of the second pawls that is located above the base being located in alignment with the circular hole and the locking hole corresponding thereto, the second hole of the other one of the second pawls that is located above the first pawl being located in alignment with the first hole and the locking hole corresponding thereto, the third pawl pivotably connected to a top of the second pawl on the base, a third toothed portion being formed on each of two ends of the third pawl, a third hole defined through the third pawl and being located in alignment with the second hole, the circular hole and one of the locking holes corresponding thereto, the second toothed ring rotatably received in the first space and having second teeth which face the first teeth at a distance, the second toothed ring having second inner teeth which are engaged with the third toothed portions of the third pawl, the top part facing the bottom part at a distance, a periphery of the top part rotatably received in the first groove, the top part having a second disk which contacts the first shoulder, a block extending from the second disk, the second toothed ring mounted to the block, the top part having four connection holes which are located in alignment with the circular holes and the locking holes, the block having a second end face which is located close to the first end faces of the columns, the second pawl located above the first pawl having a top face which is located close to the second end face;

the four locking members respectively extending through the connection holes, the first hole, the second holes, the third hole and the circular holes, and being locked to the locking holes to pivotably connect the first pawl, the second pawls and the third pawl to the locking members, two of the locking members extending through the connection holes of the top part and the circular holes of the bottom part and being locked to the locking holes corresponding thereto, one of the four locking members extending through the connection hole of the top part, the second hole, the first hole and the first hole and being locked to the locking hole corresponding thereto, another one of the locking members extending through the connection hole of the top part, the third hole, the second hole and the circular hole and being locked to the locking hole corresponding thereto;

a rotary member pivotably located in the axial hole and having third teeth at a front end thereof, the third teeth engaged with the first and second teeth at the communication hole, a recess defined in a rear end of the rotary member, an engaging groove defined in an outside of the rotary member and located in alignment with the receiving hole, a protrusion of a second body being received in the recess;

a bead located in the receiving hole and engaged with the engaging groove, and an end piece securely engaged with the receiving hole and restricting the bead from dropping out from the receiving hole.

2. The ratchet wrench as claimed in claim 1, wherein the second toothed ring is identical to the first toothed ring.

3. The ratchet wrench as claimed in claim 1, wherein the second body is a pneumatic tool, an electric tool, or a hand tool, the second body has a handle and a shank, the protrusion protrudes from an end of the shank.

4. The ratchet wrench as claimed in claim 1, wherein the end piece has outer threads which are threadedly connected to the receiving hole, the end piece has a curved recess in a front end thereof, the curved recess receives the bead.

5. The ratchet wrench as claimed in claim 1, wherein a receiving room is formed between the base and the columns, each of the columns is a rectangular column, the top part has a fourth hole defined centrally therethrough, the fourth hole is located in alignment with the receiving room, a control unit is connected to the driving unit and has an operation disk, a shaft, a first controller, two second controllers and a third controller, the operation disk is pivotably connected to the top part and protrudes beyond the annular head, the shaft extends from a center of the operation disk and pivotably extends through the fourth hole and inserted into the receiving room of the bottom part, the first controller protrudes radially from the shaft and is located in alignment with an inside of the first pawl so as to control a direction of rotation of the first pawl, the two second controllers symmetrically extend from the outside of the shaft and are located in alignment with two respective insides of the second pawls so as to control a direction of rotation of the two second pawls, the third controller protrudes radially from the shaft and is located in alignment with an inside of the third pawl so as to control a direction of rotation of the third pawl.

6. The ratchet wrench as claimed in claim 1, wherein the driving end is a rectangular end for being adapted to be connected to a rectangular recess of a socket, a connection rod, or an adapter.

7. The ratchet wrench as claimed in claim 1, wherein the recess of the rotary member is located in the axial hole and is a hexagonal recess.

8. The ratchet wrench as claimed in claim 1, wherein a resilient plate is clamped between the first end face of the bottom part and the second end face of the top part so as to adjust a distance between the top part and the bottom part.

9. The ratchet wrench as claimed in claim 1, wherein locking members are threadedly connected to the locking holes.

* * * * *